US007478455B2

(12) United States Patent
Heim

(10) Patent No.: US 7,478,455 B2
(45) Date of Patent: Jan. 20, 2009

(54) HAND-HELD CLOTHING SPOT REMOVER

(76) Inventor: Lisa Ann Heim, 7816 N. 80 th St., Milwaukee, WI (US) 53223

( * ) Notice: Subject to any disclaimer, the term of this patent is extended or adjusted under 35 U.S.C. 154(b) by 632 days.

(21) Appl. No.: 10/755,714

(22) Filed: Jan. 12, 2004

(65) Prior Publication Data

US 2004/0200007 A1 Oct. 14, 2004

Related U.S. Application Data

(60) Provisional application No. 60/439,262, filed on Jan. 10, 2003.

(51) Int. Cl.
*A47L 7/00* (2006.01)

(52) U.S. Cl. ..... 15/320; 15/322; 15/344

(58) Field of Classification Search ..... 15/320, 15/322, 323, 344, 420; *A47L 7/00*
See application file for complete search history.

(56) References Cited

U.S. PATENT DOCUMENTS

| | | | | | |
|---|---|---|---|---|---|
| 4,788,738 | A | | 12/1988 | Monson et al. | 15/320 |
| 4,903,178 | A | | 2/1990 | Englot et al. | 362/183 |
| 5,046,218 | A | * | 9/1991 | Cerri | 15/416 |
| 5,341,541 | A | | 8/1994 | Sham | 15/320 |
| 5,367,740 | A | * | 11/1994 | McCray | 15/320 |
| 5,386,612 | A | | 2/1995 | Sham | 15/320 |
| 5,392,490 | A | | 2/1995 | Monson | 15/320 |
| 5,507,068 | A | | 4/1996 | Fan et al. | 15/320 |
| 5,599,401 | A | | 2/1997 | Brosky et al. | 134/21 |
| D388,562 | S | | 12/1997 | Doria | D32/17 |
| 5,970,572 | A | | 10/1999 | Thomas | 15/320 |
| 6,031,969 | A | | 2/2000 | Burr et al. | 392/404 |
| D421,670 | S | | 3/2000 | Schupp | D32/17 |
| 6,125,498 | A | | 10/2000 | Roberts et al. | 15/320 |
| 6,347,428 | B1 | | 2/2002 | Shimko et al. | 15/320 |
| D458,424 | S | | 6/2002 | Chen | D32/17 |
| 6,550,098 | B2 | | 4/2003 | Roberts et al. | 15/320 |
| 2003/0088939 | A1 | | 5/2003 | Miner | 15/320 |

* cited by examiner

*Primary Examiner*—David A Redding
(74) *Attorney, Agent, or Firm*—Whyte Hirschboeck Dudek SC

(57) ABSTRACT

Disclosed herein is a hand-held cleaning device, as well as an associated method of cleaning a garment. The device comprises: a handle section having an interior and a garment cleaning solution reservoir located within the interior. The device further comprises a main section having a housing that defines an inner chamber, as well as a motor positioned within the inner chamber of the housing. The device also comprises a pump coupled to and powered by the motor, as well as a dirty fluid reservoir located at the bottom of the inner chamber. The device further includes a plurality of tubes connected to the pump and extending forwardly from the pump and terminating a plurality of solution dispensing spray jets. The device yet further includes a fan located in the inner chamber of the housing for creating a pressure differential to draw the dirty fluid material into the dirty fluid reservoir. Significantly, the handle section is removably coupled to the main section. A dual-use garment support surface and cleaning device storage bag can be included to provide support to a garment during cleaning by the cleaning device and to provide storage to the cleaning device when not in use.

15 Claims, 4 Drawing Sheets

HAND-HELD CLOTHING SPOT REMOVER

CROSS-REFERENCE TO RELATED APPLICATIONS

This application claims the benefit of U.S. provisional application Ser. No. 60/439,262, filed Jan., 10, 2003, the teachings and disclosures which are herein incorporated by reference.

BACKGROUND OF THE INVENTION

This invention relates cleaning devices and more particularly to hand-held cleaning devices utilizing a liquid cleaning solution.

Cleaning devices such as washing machines and washboards have existed for many years. Recently, deep cleaning vacuums including various attachments (e.g., the Bissell® ProHeat, Dirtdevil® Platinum Force, and the Hoover® Spin Scrub) have appeared to increase the ability of the average person to clean heavily soiled or stained items. Some of these devices have been reduced in size and are configured as hand-held deep cleaning devices for clothing. However, the effectiveness of these reduced size cleaning devices has been limited.

A new cleaning device that is hand-held and particularly well suited for use as a spot remover for clothing would be welcomed by those in the art. The new device preferably eliminates the need to manually scrub clothing, thereby preventing wetting of the entire garment during the cleaning operation. The new device preferably quickly and efficiently removes stains from clothing and similar items, and will allow the garment or item to be worn or used after a relatively short period of time, due to the fact that the entire garment is not wetted during the cleaning operation.

Other hand-held cleaning devices are known, including the Bissell® Spot Lifter and the Dirt Devil® Spot Scrubber, among others. However, none of the other known commercial devices employ a combination of convenience, space utilization for compactness, functionality, as well as hand-held specific component placement and housing footprint that minimizes deadspace.

Also, it has been found that pulsing a stain with a cleansing agent provides maximum cleaning power, by using the force of a repeated jet, combined with an economy of cleaning agent, since there is not a continuous flow to the stain during wetting. Finally, it would be desirable to have a readily available backing surface wherever the cleaning device is used.

BRIEF SUMMARY OF THE INVENTION

The invention herein addresses the needs described above. Disclosed herein is a hand-held cleaning device, as well as an associated method of cleaning a garment. The device comprises: a handle section having an interior and a garment cleaning solution reservoir located within the interior. The device further comprises a main section having a housing that defines an inner chamber, as well as a motor positioned within the inner chamber of the housing. The device also comprises a pump coupled to and powered by the motor, as well as a dirty fluid reservoir located at the bottom of the inner chamber. The device further includes a plurality of tubes connected to the pump and extending forwardly from the pump and terminating a plurality of solution dispensing spray jets. The device yet further includes a fan located in the inner chamber of the housing for creating a pressure differential to draw the dirty fluid material into the dirty fluid reservoir. The handle section is removably coupled to the main section. A dual-use garment support surface and cleaning device storage bag can be included to provide support to a garment during cleaning by the cleaning device and to provide storage to the cleaning device when not in use.

Other embodiments, aspects and advantages will become apparent in view of the teachings that follow, including the drawings.

BRIEF DESCRIPTION OF THE DRAWINGS

The drawings illustrate the best mode presently contemplated for carrying out the invention.

In the drawings.

Figure 1:
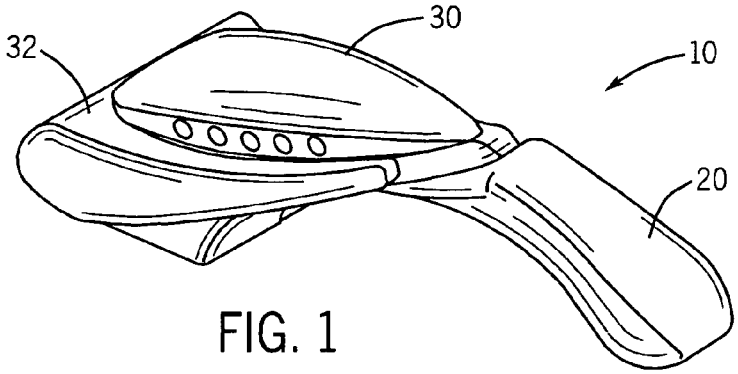
FIG. 1 is a perspective view of hand-held cleaning device according to one aspect of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE INVENTION

FIGS. 1-4 illustrate a hand-held cleaning device 10 for deep cleaning clothing, upholstery, carpets, and the like. The hand-held cleaning device is also effective as a spot remover for removing stains from various items, including but not limited to, knits, ties, and delicates, as well as various fabrics, including but not limited to, polyester, wool, and cotton, among others.

Figure 2:
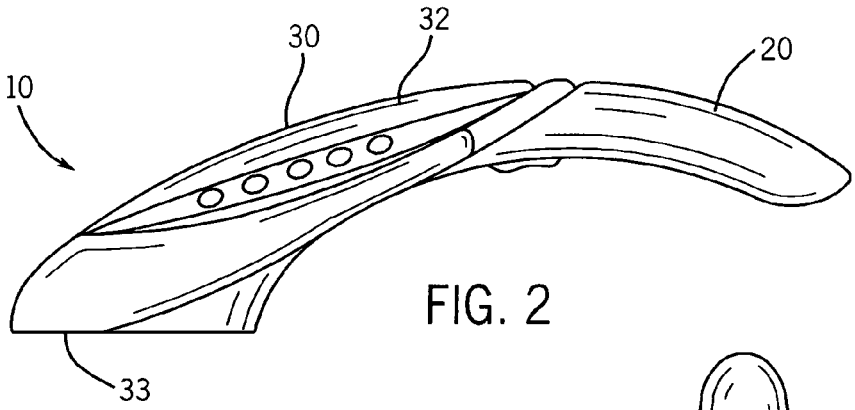
FIG. 2 is a side view of the hand-held cleaning device of FIG. 1.
Figure 3:
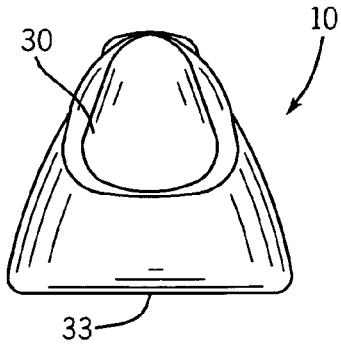
FIG. 3 is an front view of the hand-held cleaning device of FIG. 1.
Figure 4:
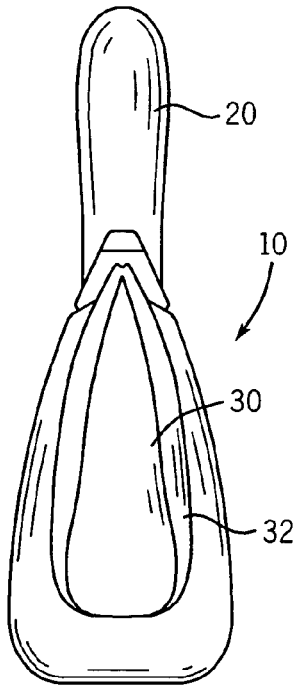
FIG. 4 is a top view of the hand-held cleaning device of FIG. 1.

More specifically, FIG. 1 is a perspective view of the hand-held cleaning device 10 according to one aspect of the present invention. FIGS. 2-4 are side, front and top views, respectively, of the hand-held cleaning device of FIG. 1. As shown, the hand-held cleaning device 10 includes a handle section 20 and a main section 30. In one embodiment, the handle section 20 includes a housing having a contoured shape. It will be understood that the shape shown is exemplary only, and that other embodiments are possible so long as they accomplish the functionalities (as described in greater detail below) of the present invention. Moreover, the contoured shape promotes an ergonomic look and feel to the overall device. In one embodiment, the main section 30 includes a main section housing 32 has a triangular profile viewed from the top, as shown in FIG. 4. In general, it can also be said that the main section housing 32 has a widening taper extending from the handle section 20, to a substantially flat surface portion 33, which provides a contact surface for contacting a garment that is to be cleaned. In one embodiment, the garment cleaning solution reservoir occupies substantially all of the interior of the handle section.

Figure 5:
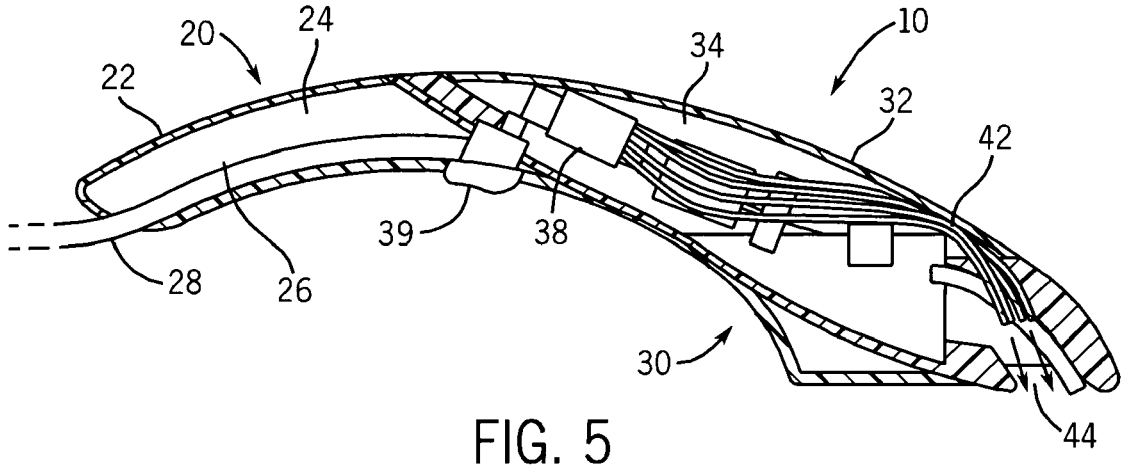
FIG. 5 is a side view with a portion cut away of the hand-held cleaning device of FIG. 1.
Figure 6:
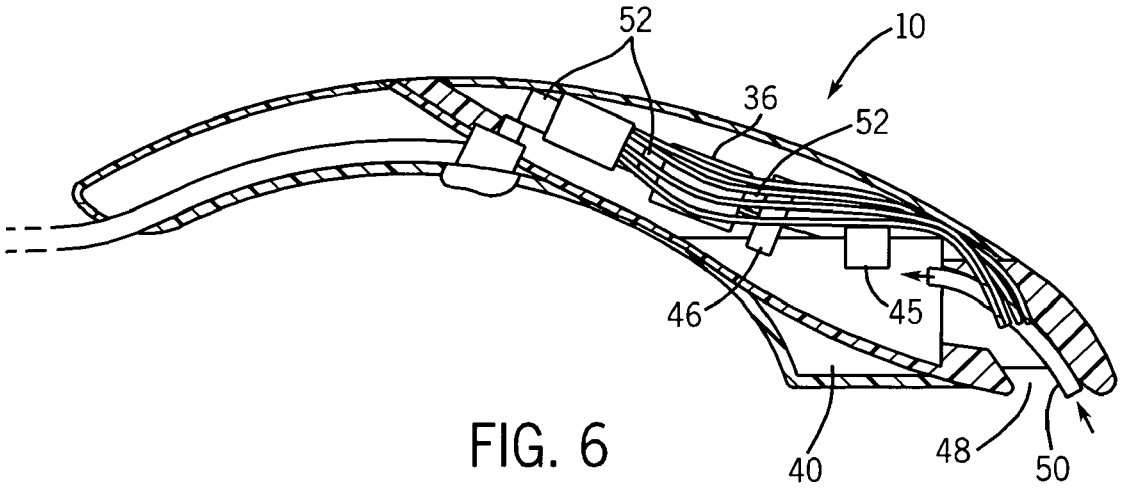
FIG. 6 is a side view with a portion cut away of the hand-held cleaning device of FIG. 1.

FIGS. 5-6 are side views with portions cut away of the hand-held cleaning device 10. The device 10 includes a handle section 20, and the handle section has a housing 22 that defines an interior 24. A garment cleaning solution reservoir 26 is located within the interior 24. The reservoir 26 can be contoured and sized to fit within the handle and to maximize the amount of cleaning solutions storable therein. The reservoir is also sized and shaped to minimize or reduce "dead space" within the handle, so that the overall size of the handle can be reduced as well. In this fashion, the reservoir is interior to, and therefore integral with, the handle section (as opposed to requiring a standalone or separate garment cleaning solution container or reservoir). The solution reservoir may be filled with a variety of commercially available detergents or cleaning solutions. Since the cleaning solution is liquid (or perhaps a gel or malleable and flowing material), the shape of the reservoir 26 can vary to convenience so long as the benefits above are achieved.

The device 10 can be powered by a AC connection via cord 28, which extends through the handle and into the housing. However, other powering means or methods are contemplated and within the scope of the present invention. For example, in one embodiment (not shown) a rechargeable power pack or disposable batteries can be integrated with, so as to power, the device.

Still referring to FIGS. 5-6, a main section 30 is shown. The main section comprises a housing 32 that defines an inner chamber 34. A motor 36 is positioned within the inner chamber 34 of the housing 32. The motor 36 receives power from the powering means and a pump 38 is coupled to and powered by the motor. The motor is coupled to an external trigger 39 that selectively provides power from the electric cord, and a pump coupled to the motor. A dirty fluid reservoir 40 is located at the bottom of the inner chamber 34. A plurality of tubes 42 is connected to the pump 38 and extend forwardly from the pump, terminating in a plurality of solution dispensing spray jets 44. A filter element 45 is positioned between the used solution reservoir and the frontal portion of the housing, which is used to filter out particulate from the used (or dispensed) cleaning solution or to filter out the air leaving the main section 30. Advantageously, it is of note that the handle section 20 is removably coupled to the main section 30, which provides an ease of use by removing the handle section 20, adding any necessary cleaning agent, and reattaching the handle section to the main section 30. The pneumatic system is an integral part of the hand-held cleaning device 10, therefore air flow is critical to provide the requisite pulsing power and suction power for the device to operate properly. A fan 46 is located in the inner chamber 34 of the housing 32 for creating a pressure differential to draw dirty fluid material (i.e., garment cleaning solution plus any contents of stains removed from the garments cleaned) into the dirty fluid reservoir 40. Because it is a pneumatic system, whenever there is suction, there has to be proper venting to release the pressure created by the vacuum that supplies the suctioning power.

Still referring to FIGS. 5-6, the main section housing 32 terminates in a substantially flat surface portion 33, described above, which serves as the cleaning contact area for contacting and cleaning the garment. More specifically, the portion 33 includes a first location 48 coinciding with the spray jets 36, where pulsating dispersion of cleaning solution to the garment takes place, and the portion 33 also includes a second location 50 at which dirty cleaning solution is suctioned up or away from the garment after use (i.e., after cleaning of the garment is accomplished). Upon activating trigger 39, pump 38 draws garment cleaning solution from solution reservoir 26 to provide solution via tubes 42 out of location 48 to the garment to be cleaned. Trigger 39 accomplished its function in a known manner to initiate pumping and suctioning as needed. The dirty fluid solution is pulled upwardly into the main section 30 and dispensed into the dirty fluid reservoir 40 with the associated air (for providing vacuum or suction) being vented out of the main section, and more specifically the main section housing 32, via vents 52. The operation of the cleaning device includes removing the handle and filling the solution reservoir with water and/or a stain removing solution chosen based upon the type of stain to be cleaned. The handle is snapped back into place and the electric cord is plugged into a standard outlet. A carrying bag that is provided with the cleaning device is placed under a soiled area of a garment. The trigger, which is located under the handle, is depressed thereby activating the pump and the fan. Activation of the pump and fan results in cleaning solution being pumped through the tubes toward the spray jets, and a vacuum being created in the used solution reservoir.

Operation/Use

Figure 7:
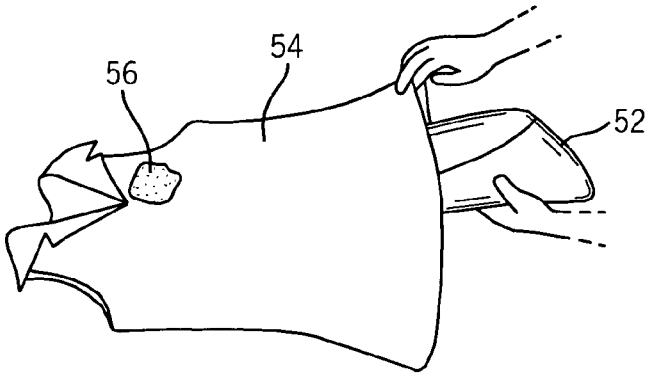
FIGS. 7-10 is an illustration of various stages of the hand-held cleaner in operation and used with the support bag surface.
Figure 8:
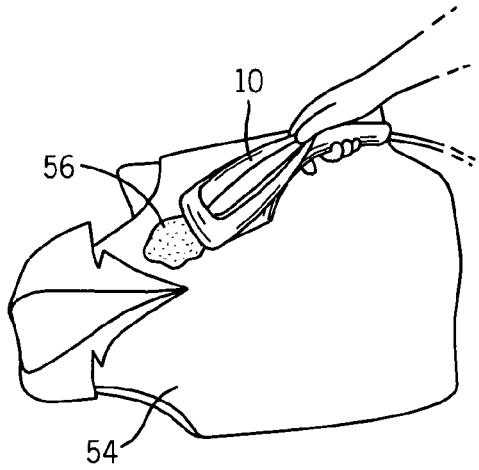
Figure 9:
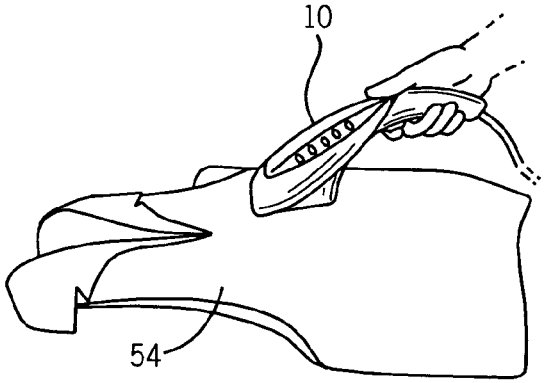
Figure 10:
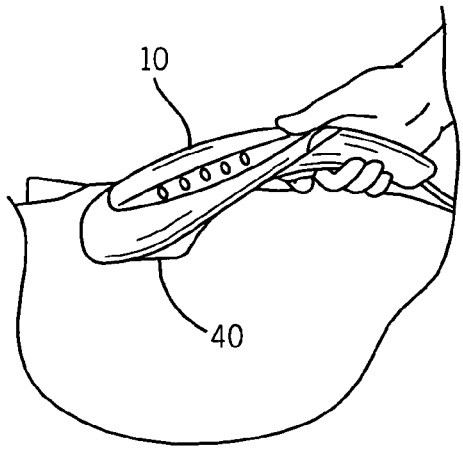

FIGS. 7-10 illustrate various stages of the hand-held cleaner 10 in operation and used with a dual use carry and support bag surface 52. A typical application is as follows. Support bag surface 52 is placed underneath soiled garment 54 such that the surface is adjacent the soiled garment area 56, as shown in FIG. 7. As shown in FIG. 8, the cleaning device 10 is used to wet the soiled area 56 of garment 54 with cleaning solution. As shown in FIG. 9, the cleaning device 10 is pressed downwardly against the garment 54 while being simultaneously pulled across the surface of the garment and over the stain or soiled area 56 in a cleaning motion. During cleaning, the spray jets of FIG. 5 spray cleaning solution onto the garment 54. The pump 38 of the cleaning device 10 draws the cleaning solution from the garment 54 and into the dirty fluid reservoir 40 as the cleaning motion is executed, thereby gently yet effectively removing the stain, as shown in FIG. 10. The cleaning motion is repeated until the stain is removed.

After a cleaning operation, the electric cord is unplugged and the used solution reservoir is removed and emptied of used solution. The used solution reservoir is then snapped back into place for subsequent cleaning operations. If the filter element becomes excessively soiled, the filter element may also be removed and rinsed under water or other cleaning solvents. The filter element may then be reinstalled for subsequent cleaning operations.

The housing, the handle, and the solution reservoirs may be injection molded, preferably suing recyclable thermoplastic resins. The device also preferably includes a relatively large handle, thereby facilitating use by elderly or disabled individuals.

Figure 11:
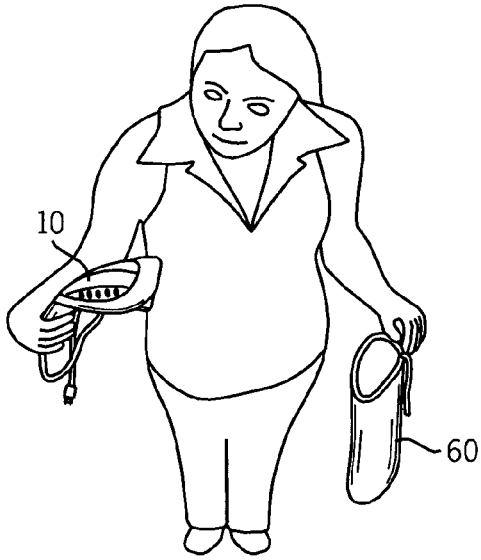
FIGS. 11-15 illustrate the use of the combination hand-held cleaning device carrying case used as a bag.
Figure 12:
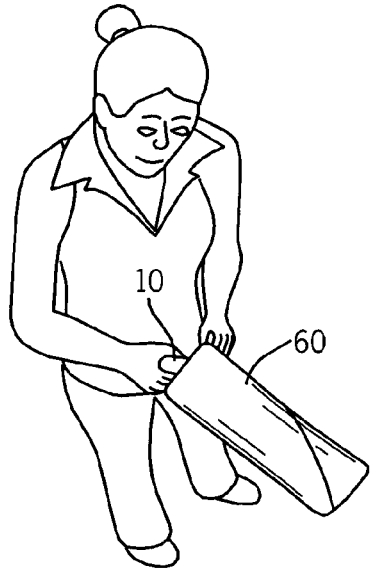
Figure 13:
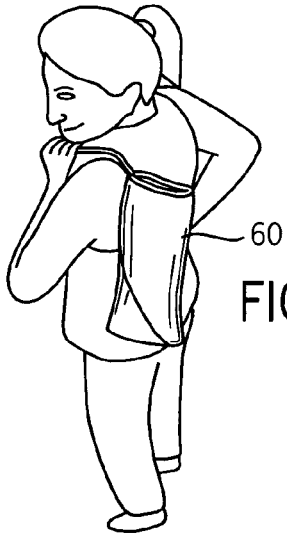
Figure 14:
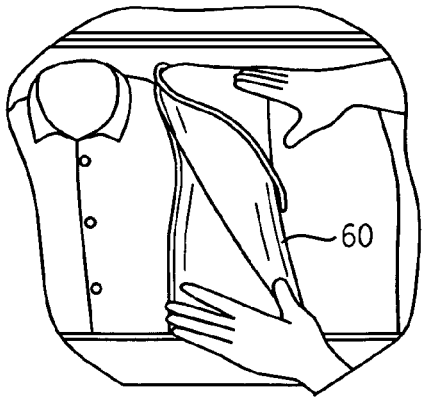
Figure 15:
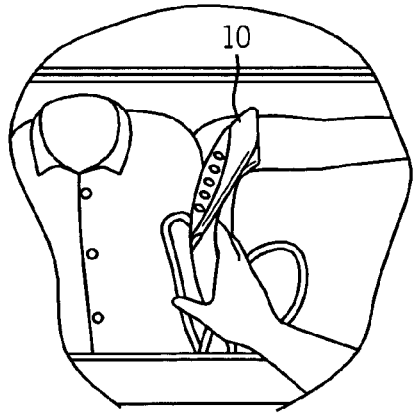

FIGS. 11-15 illustrate the use of the combination hand-held cleaning device carrying case used as a bag 60. FIG. 11 shows an opening of the bag 60 into which the unit 10 may be inserted for transporting, the insertion of which is demonstrated in FIG. 12, by inserting the unit into one end of the bag 60. As shown in FIG. 13, a rope, draw string, or other tying device can be used to secure the bag 60, as well as to permit carrying of the bag in a tote-like fashion. FIG. 14 illustrates the storage of the bag 60. Since the device is intended to be easily transported, it is contemplated that the unit will be easily contained in luggage, and thus, proximate clothing to which it may be ultimately used for cleaning. Because the bag is resident with the cleaning device 10 during transport, it is not necessary to search for other support materials in the attempt to remove a stain from a garment, as all components are readily available. The bag 60 has a "dual functionality" in that it provides a carrying or carriage function, as well as an underbody support mechanism to prevent stain wicking to other clothing, or since the unit can be used when clothes are worn, it prevents stains from bleeding to other clothing.

A method of cleaning a garment in the environment of the hand-held cleaning device described herein is also disclosed. The method comprises filling the garment cleaning solution reservoir with a garment cleaning solution; drawing the garment cleaning solution from the garment cleaning solution reservoir through the plurality of tubes; applying, via the plurality of solution dispensing spray jets, the garment cleaning solution to a localized soiled area of a garment, creating a dirty fluid at the localized soiled area of the garment; and drawing at least a portion of the dirty fluid away from the localized soiled area of the garment to dirty fluid reservoir, thereby cleaning the localized soiled area of the garment. The applying step can further be defined as pulsatingly applying the garment cleaning solution. The method can further comprise interposing a material layer underneath the localized soiled area of the garment prior to applying the garment cleaning solution to the area. And the material is a part of a dual-use garment support surface and cleaning device storage bag. And the method can further comprise detaching, prior to the filling, the handle section from the main section., as well as re-attaching, following the filling, the handle section from the main section.

Methods have been described and outlined in a sequential fashion. Still, modification, rearrangement, reordering, or the like, of the methods is contemplated and considered within the scope of the appending claims. More generally, while the present invention has been described in terms of one or more preferred embodiments, it is recognized that equivalents, alternatives, and modifications, aside from those expressly stated, are possible and within the scope of the appending claims.

What is claimed is:

1. A hand-held cleaning device for cleaning a garment comprising:

a handle section, the handle section having a housing defining an interior and a garment cleaning solution reservoir located within the interior; and a main section, the main section comprising:

a housing defining an inner chamber;

a motor positioned within the inner chamber of the housing;

a pump coupled to and powered by the motor;

a dirty fluid reservoir located at the bottom of the inner chamber;

a plurality of tubes connected to the pump and extending forwardly from the pump and terminating a plurality of solution dispensing spray jets; and a fan located in the inner chamber of the housing for creating a pressure differential to draw the dirty fluid material into the dirty fluid reservoir;

wherein the handle section is removably coupled to the main section.

2. The hand-held cleaning device of claim 1 wherein the garment cleaning solution reservoir occupies substantially all of the interior of the handle section.

3. The hand-held cleaning device of claim 1 further including a dual-use garment support surface and cleaning device storage bag for providing support to a garment during cleaning by the cleaning device and to provide storage to the cleaning device when not in use.

4. The hand-held cleaning device of claim 3 wherein the dual-use garment support surface and cleaning device storage bag is constructed of a material including neoprene.

5. The hand-held cleaning device of claim 1 wherein the solution dispensing spray jets are for pulsatingly spraying the cleaning solution towards the garment.

6. The hand-held cleaning device of claim 1 wherein at least a portion of the housing of the cleaning device is substantially clear to permit viewing of at least a portion of the interior of the cleaning device.

7. The hand-held cleaning device of claim 1 wherein the cleaning device has a substantially triangular profile when viewed from a top of the cleaning device.

8. A hand-held cleaning device in combination with a dual-use garment support surface and cleaning device storage bag, the combination comprising:

a handle section, the handle section having a housing defining an interior and a garment cleaning solution reservoir located within the interior; and a main section, the main section comprising:

a housing defining an inner chamber;

a motor positioned within the inner chamber of the housing;

a pump coupled to and powered by the motor;

a dirty fluid reservoir located at the bottom of the inner chamber;

a plurality of tubes connected to the pump and extending forwardly from the pump and terminating a plurality of solution dispensing spray jets; and a fan located in the inner chamber of the housing for creating a pressure differential to draw the dirty fluid material into the dirty fluid reservoir; and a dual-use garment support surface and cleaning device storage bag for providing support to a garment during cleaning by the cleaning device and to provide storage to the cleaning device when not in use;

wherein the handle section is removably coupled to the main section wherein the garment cleaning solution reservoir occupies substantially all of the interior of the handle section.

9. The combination of claim 8 wherein the dual-use garment support surface and cleaning device storage bag is constructed of a material including neoprene.

10. The combination of claim 8 wherein the solution dispensing spray jets are for pulsatingly spraying the cleaning solution towards the garment.

11. The combination of claim 8 wherein at least a portion of the housing of the cleaning device is substantially clear to permit viewing of at least a portion of the interior of the cleaning device.

12. The combination of claim 8 wherein the cleaning device has a substantially triangular profile when viewed from a top of the cleaning device.

13. A hand-held cleaning device for cleaning a localized soiled area of a garment, the device comprising:

a handle section, the handle section having a housing defining an interior and a garment cleaning solution reservoir located within the interior for receiving garment cleaning solution; and a main section, the main section comprising:

a housing defining an inner chamber;

a motor positioned within the inner chamber of the housing;

a pump coupled to and powered by the motor;

a dirty fluid reservoir located at the bottom of the inner chamber;

a plurality of tubes connected to the pump and extending forwardly from the pump and terminating a plurality of solution dispensing spray jets; and a fan located in the inner chamber of the housing for creating a pressure differential to draw the dirty fluid material into the dirty fluid reservoir;

wherein the handle section is removably coupled to the main section; and wherein the coupling of the pump to the motor provides for a pulsating spray of garment cleaning solution from the garment cleaning solution reservoir via the plurality of solution dispensing spray jets to the localized soiled area of the garment.

14. The device of claim 13 wherein the plurality of tubes are used to draw the garment cleaning solution from the garment cleaning solution reservoir and wherein the plurality of spray jets dispense the solution from tubes.

15. The device of claim 13 wherein, once the garment cleaning solution is applied in pulsating fashion via the spray jets to the localized soiled area of the garment to create a dirty fluid material at the localized soiled area of the garment, and the fan is used to draw at least a portion of the dirty fluid material away from the localized soiled area of the garment to the dirty fluid reservoir, thereby cleaning the localized soiled area of the garment.

* * * * *